US007632065B2

(12) United States Patent
Kawabata et al.

(10) Patent No.: US 7,632,065 B2
(45) Date of Patent: Dec. 15, 2009

(54) CENTRIFUGAL PUMP AND METHOD OF MANUFACTURING THE SAME

(75) Inventors: Junya Kawabata, Tokyo (JP); Kikuichi Mori, Tokyo (JP); Hiroyuki Kato, Tokyo (JP)

(73) Assignee: Ebara Corporation, Tokyo (JP)

( * ) Notice: Subject to any disclaimer, the term of this patent is extended or adjusted under 35 U.S.C. 154(b) by 465 days.

(21) Appl. No.: 11/587,359

(22) PCT Filed: Nov. 12, 2004

(86) PCT No.: PCT/JP2004/017222

§ 371 (c)(1),
(2), (4) Date: Oct. 23, 2006

(87) PCT Pub. No.: WO2005/103499

PCT Pub. Date: Nov. 3, 2005

(65) Prior Publication Data

US 2007/0224040 A1 Sep. 27, 2007

(30) Foreign Application Priority Data

Apr. 26, 2004 (JP) ..... 2004-130203

(51) Int. Cl.
*F04D 29/44* (2006.01)

(52) U.S. Cl. ..... 415/199.1; 415/199.2; 415/200; 415/182.1; 415/215.1; 415/216.1; 29/888.02; 29/888.024

(58) Field of Classification Search ..... 415/199.1, 415/199.2, 200, 182.1, 215.1, 216.1; 29/888.02, 29/888.024

See application file for complete search history.

(56) References Cited

U.S. PATENT DOCUMENTS

| | | | | |
|---|---|---|---|---|
| 5,256,033 | A | 10/1993 | Kajiwara | |
| 5,369,972 | A * | 12/1994 | Kajiwara et al. | 72/348 |
| 6,267,555 | B1 * | 7/2001 | Chien et al. | 415/172.1 |
| 6,398,493 | B1 * | 6/2002 | Chien et al. | 415/199.2 |
| 6,439,835 | B1 * | 8/2002 | Chien et al. | 415/104 |
| 2005/0002789 | A1 | 1/2005 | Kajiwara et al. | |

FOREIGN PATENT DOCUMENTS

| | | |
|---|---|---|
| DE | 744 266 | 1/1994 |
| DE | 43 10 466 | 10/1994 |
| DE | 198 22 923 | 11/1999 |
| EP | 0 588 258 | 3/1994 |
| EP | 0 646 729 | 4/1995 |
| JP | 50-58601 | 5/1975 |
| JP | 54-18704 | 2/1979 |
| JP | 60-133199 | 9/1985 |
| JP | 61-210299 | 9/1986 |
| JP | 2-5798 | 1/1990 |
| JP | 2000-227227 | 8/2000 |
| JP | 2000-334573 | 12/2000 |
| JP | 2002-39093 | 2/2002 |
| JP | 2004-183486 | 7/2004 |

* cited by examiner

*Primary Examiner*—Igor Kershteyn
(74) *Attorney, Agent, or Firm*—Wenderoth, Lind & Ponack, L.L.P.

(57) ABSTRACT

A centrifugal pump includes a diffuser section for decreasing a velocity of the fluid discharged from an impeller, a return vane for leading the fluid which has passed through the diffuser section to a discharge side, and a main plate to which the diffuser section and the return vane are fixed.

9 Claims, 8 Drawing Sheets

CENTRIFUGAL PUMP AND METHOD OF MANUFACTURING THE SAME

TECHNICAL FIELD

The present invention relates to a centrifugal pump, and more particularly to a centrifugal pump whose components such as an impeller and a casing are manufactured from a sheet metal and a method of manufacturing such a centrifugal pump.

BACKGROUND ART

Generally, in order to efficiently convert velocity energy of a fluid into pressure energy, a centrifugal pump is required to have a mechanism for decreasing a velocity of the fluid discharged from an impeller so as to recover a pressure head. Further, a multistage centrifugal pump having a plurality of impellers disposed in series is required to have a mechanism for leading a fluid from a certain-stage impeller to a next-stage impeller.

Thus, in a multistage centrifugal pump, a guide vane is widely used as a mechanism for decreasing a velocity of a fluid and leading the fluid to a next-stage impeller. This guide vane comprises diffuser passages for decreasing a velocity of a fluid discharged from an impeller, and return passages for leading the fluid, which has passed through the diffuser passages, to the next-stage impeller, as disclosed in the Japanese laid-open utility model publication No. 6-40958.

Since the above-mentioned diffuser passages and the return passages have a complicated shape, it has been customary to form the guide vane by using resin or by casting. The resin guide vane and the cast guide vane can have smooth passages therein for leading the fluid to a suction port of the next-stage impeller, and hence an excellent pump performance can be obtained.

However, the resin guide vane may be corroded depending on the characteristics of the fluid. Therefore, the types of fluids which the pump can handle are limited. Further, if the pump is used for delivering waste water, the resin guide vane is worn by suspended substances such as sands contained in the waste water. On the other hand, in a case of using the cast guide vane, the corrosion and the wear can be prevented from occurring. However, the cast guide vane causes a manufacturing cost to increase.

In order to solve such problems, there has been proposed a centrifugal pump having a diffuser section for decreasing a velocity of a fluid discharged from a rotating impeller, a plurality of return vanes for leading the fluid, which has passed through the diffuser section, toward a discharge side, and a main plate to which the diffuser section and the return vanes are fixed, all of which are manufactured from a sheet metal.

SUMMARY OF THE INVENTION

The centrifugal pump having the diffuser section, the return vanes, and the main plate, which are manufactured from a sheet metal, are excellent in corrosion resistance and wear resistance, and can pressurize the fluid with a high efficiency. An object of the present invention is to provide a centrifugal pump which has such advantages and can further improve a pump performance, and to provide a method of manufacturing such a centrifugal pump.

In order to achieve the above object, according to one aspect of the present invention, there is provided a centrifugal pump for pressurizing a fluid by rotating an impeller, the centrifugal pump comprising: a diffuser section for decreasing a velocity of the fluid discharged from the impeller; a return vane for leading the fluid which has passed through the diffuser section to a discharge side; a main plate to which the diffuser section and the return vane are fixed; and a structural member for smoothening a step formed in a passage extending from the diffuser section to the return vane.

According to the present invention, because the structural member smoothens the step formed in the passage extending from the diffuser section to the return vane, a resistance against the fluid flowing through the passage can be small and a loss can thus be small. Therefore, a high-efficient centrifugal pump can be achieved.

In a preferred aspect of the present invention, the diffuser section, the return vane, the main plate, and the structural member are formed from a sheet metal.

In a preferred aspect of the present invention, the structural member is a cover plate formed from a single sheet metal.

In a preferred aspect of the present invention, the return vane engages with the cover plate to prevent the cover plate from moving.

According to the present invention, because all the components such as the diffuser section, the return vane, the main plate, and the structural member are formed from a sheet metal such as stainless steel, a centrifugal pump having an excellent corrosion resistance and an excellent wear resistance can be achieved.

According to another aspect of the present invention, there is provided a method of manufacturing a centrifugal pump for pressurizing a fluid by rotating an impeller, the method comprising: forming a diffuser section from a sheet metal, the diffuser section being provided for decreasing a velocity of the fluid discharged from the impeller; forming a return vane from a sheet metal, the return vane being provided for leading the fluid which has passed through the diffuser section to a discharge side; forming a main plate from a sheet metal, the diffuser section and the return vane being fixed to the main plate; forming a structural member from a sheet metal, the structural member being provided for smoothening a step formed in a passage extending from the diffuser section to the return vane; and assembling the diffuser section, the return vane, the main plate, and the structural member by welding processes, the welding processes being performed from the same side.

According to the present invention, because all the components are formed from a sheet metal and are assembled by the welding processes which are performed from the same side, the centrifugal pump having an excellent corrosion resistance and an excellent wear resistance can be easily manufactured.

In a preferred aspect of the present invention, the structural member and the return vane are integrally assembled by a single welding process.

According to the present invention, the structural member and the return vane can be easily assembled.

DETAILED DESCRIPTION OF THE INVENTION

Figure 1:
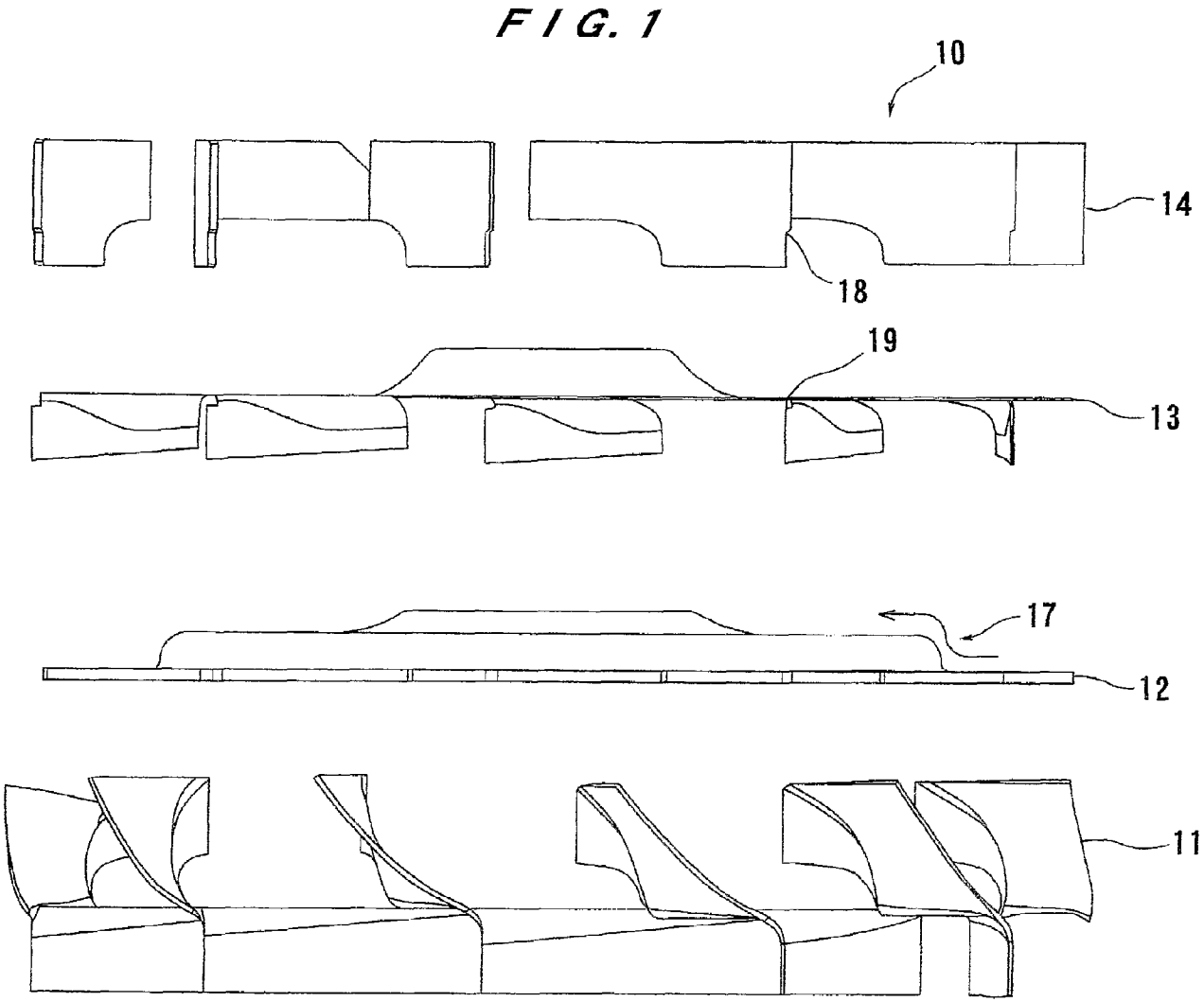
FIG. 1 is a view showing components constituting a guide vane incorporated in a centrifugal pump according to an embodiment of the present invention.
Figure 2A:
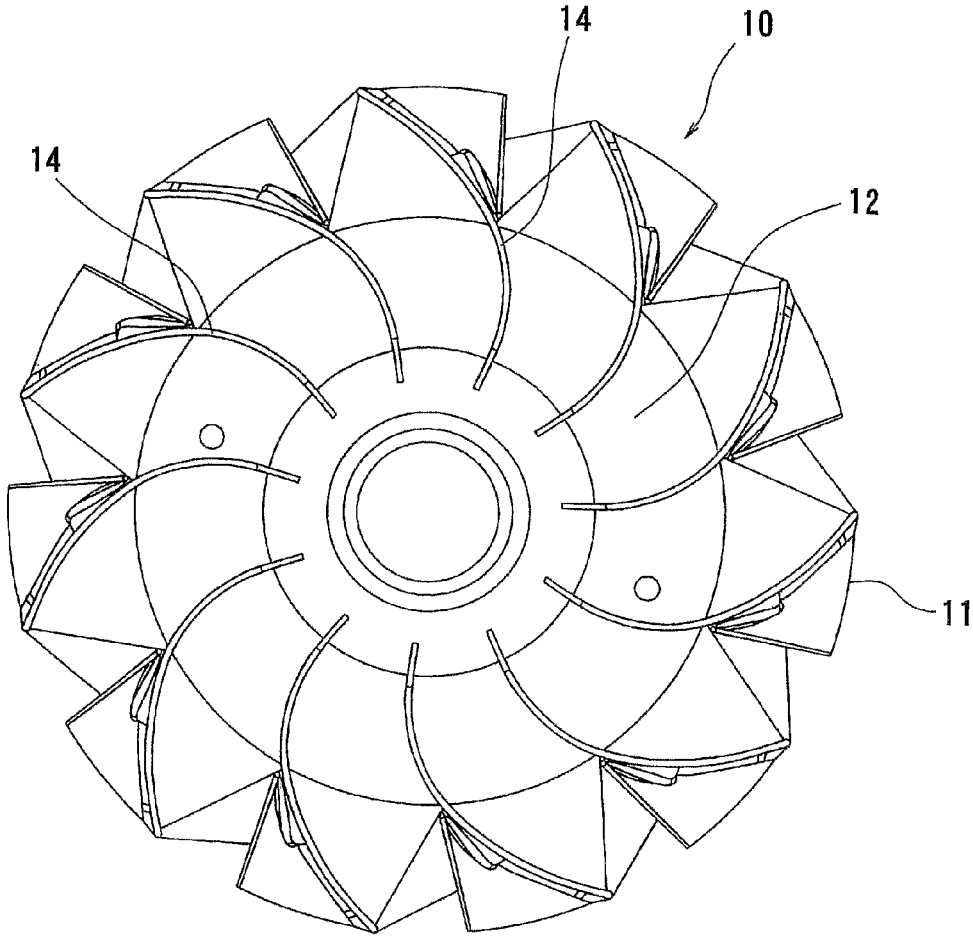
FIG. 2A is a plan view showing the guide vane of the centrifugal pump according to the embodiment of the present invention.
Figure 2B:
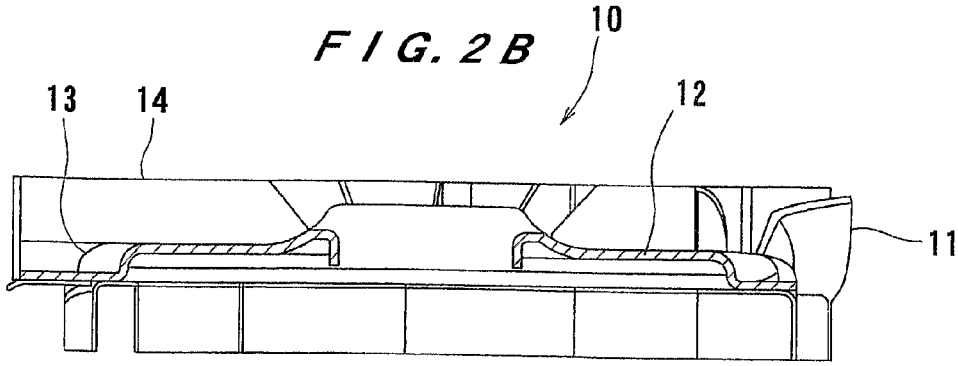
FIG. 2B is a vertical cross-sectional view showing the guide vane of the centrifugal pump according to the embodiment of the present invention.
Figure 3:
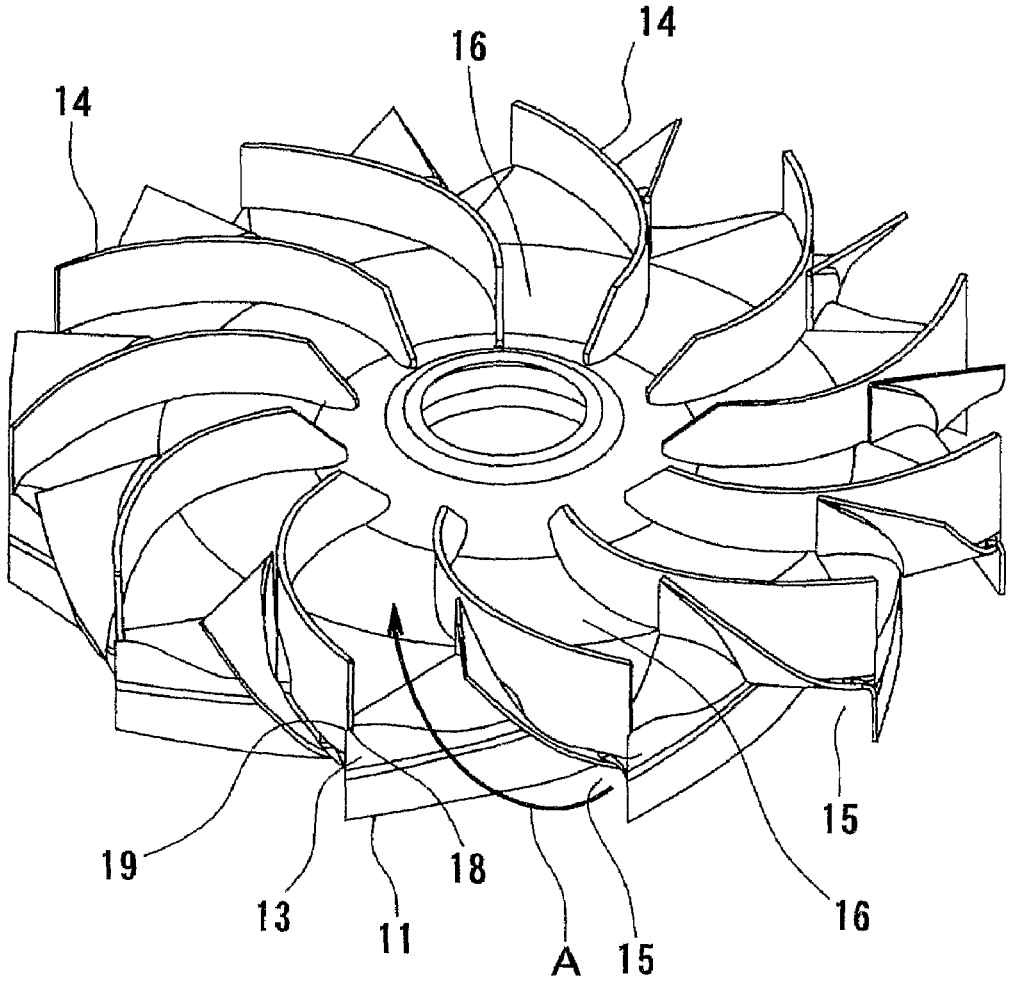
FIG. 3 is a schematic view showing the guide vane of the centrifugal pump according to the embodiment of the present invention.

A centrifugal pump according to an embodiment of the present invention will be described below with reference to the drawings. As shown in FIGS. 1 through 3, a guide vane 10 of the centrifugal pump comprises a diffuser section 11 for forming diffuser passages 15, a plurality of return vanes 14 for forming return passages 16, and a main plate 12 to which the diffuser section 11 and the return vanes 14 are fixed. The diffuser section 11, the return vanes 14, and the main plate 12 are formed from a sheet metal such as stainless steel.

The diffuser section 11 is divided into each of the diffuser passages 15, and is fixed to the main plate 12 by welding. The return vanes 14 are divided into each of the return passages 16, and are fixed to the main plate 12 by welding. In the structures of these components, as shown in FIG. 1, a step 17 of the main plate 12 is formed in the fluid passages, and hence an integral cover plate 13 is additionally provided between the return vanes 14 and the main plate 12 so as to smoothen the step 17.

Figure 8:
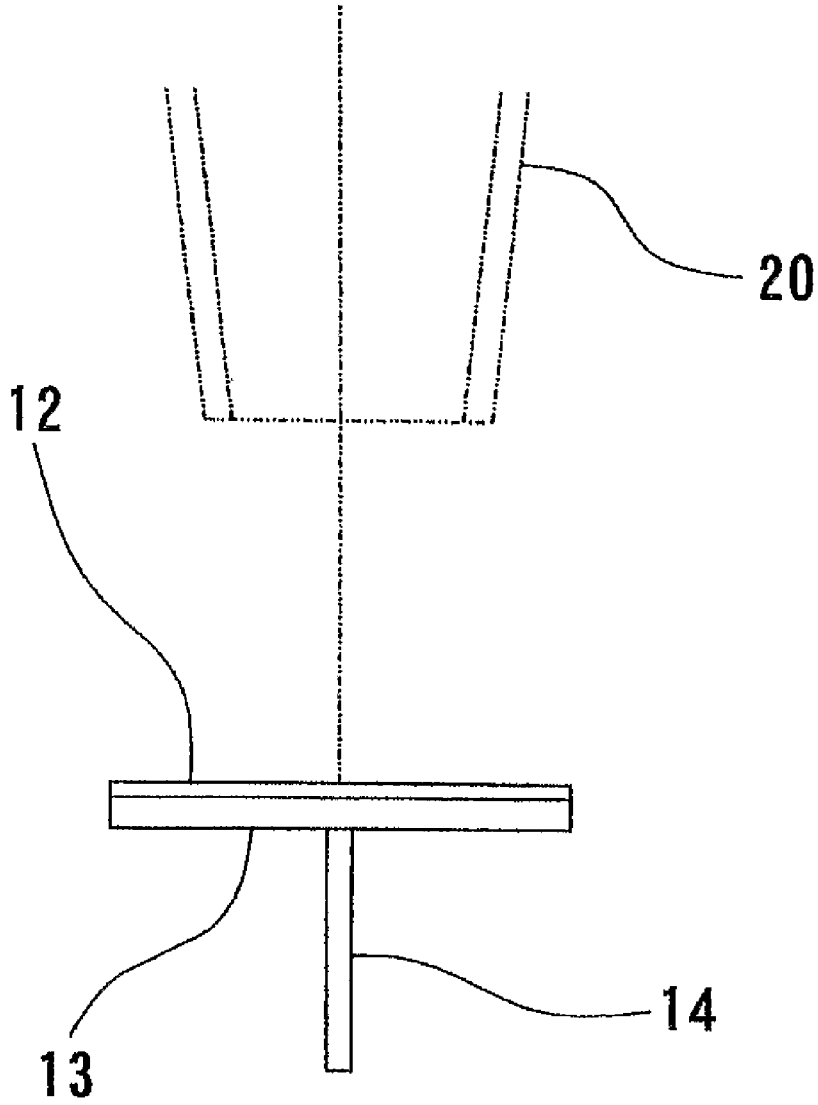
FIG. 8 is a view illustrating the manner of welding the main plate, a cover plate, and the return vane.

As shown in FIG. 1, the cover plate 13 is formed from a single sheet metal. Thus, the guide vane 10 can be easily assembled, and each of the return passages 16 has a smooth flow passage. The cover plate 13 is assembled as shown in FIG. 8. Specifically, the cover plate 13 is placed between the main plate 12 and the return vane 14, and the main plate 12, the cover plate 13 and the return vane 14 are welded and integrated by penetration welding of laser using a nozzle 20 provided at the side of the main plate 12. In this manner, the main plate 12, the cover plate 13 and the return vane 14 are assembled by a single welding process, i.e., the penetration welding. Further, as shown in FIG. 1, engaging portions 18 and 19 are provided on the return vane 14 and the cover plate 13, respectively, and when welding finishes, as shown in FIG. 3, the engaging portion 19 of the cover plate 13 is pressed by the engaging portion 18 of the return vane 14, so that the outer peripheral portion of the cover plate 13 is prevented from moving.

As described above, the guide vane 10 comprises the diffuser section 11 for forming the diffuser passages 15, the return vanes 14 for forming the return passages 16, the main plate 12 for fixing the diffuser section 11 and the return vanes 14, and the cover plate 13 interposed between the return vanes 14 and the main plate 12. Therefore, as indicated by the arrow A, a liquid discharged from a rotating impeller (described later) changes its course and flows into the return passages 16, and is then led to a discharge side (i.e., a discharge port of the pump or a next-stage impeller). As such, each diffuser passage 15 communicates with a corresponding one of the return passages 16 to form a pressure head recovery passage separated from circumferentially adjacent pressure head recovery passages (i.e., separated from other pressure head recovery passages).

Figure 4:
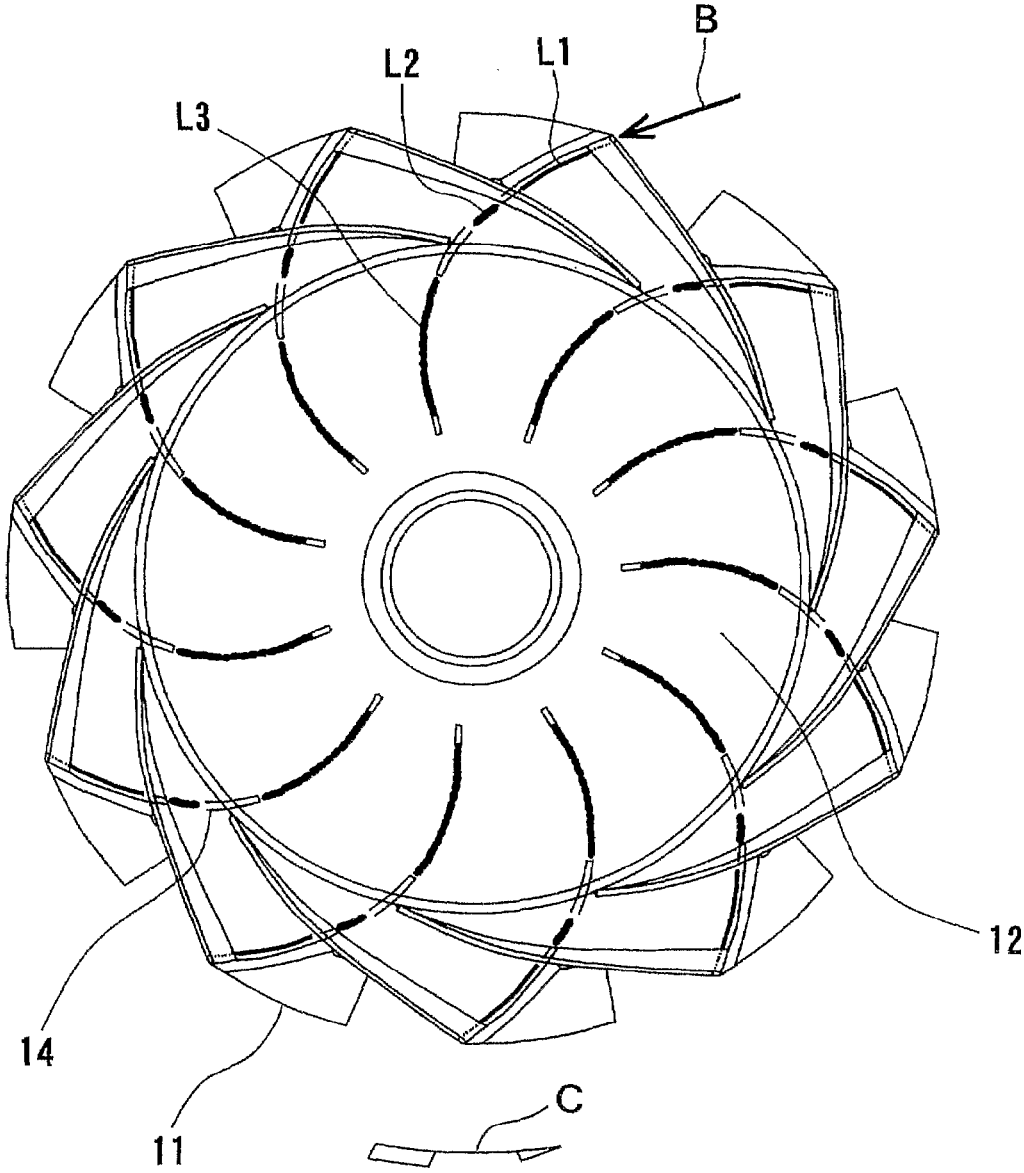
FIG. 4 is a plan view illustrating the manner of welding and assembling the guide vane of the centrifugal pump according to the embodiment of the present invention.
Figure 5:
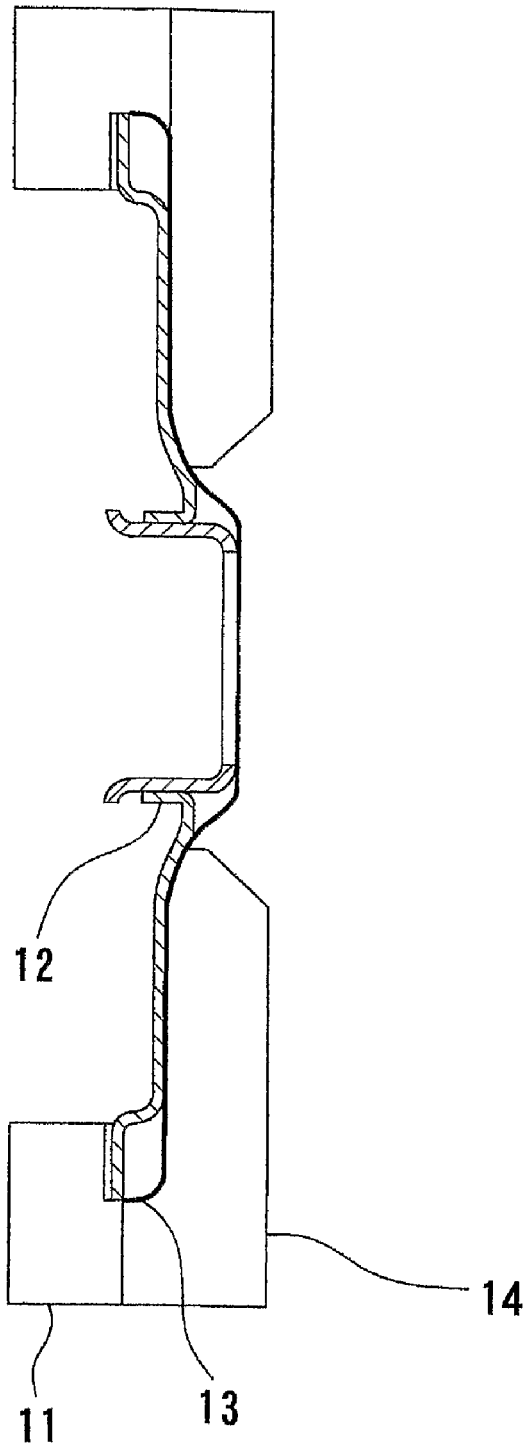
FIG. 5 is a vertical cross-sectional view illustrating the manner of welding and assembling the guide vane of the centrifugal pump according to the embodiment of the present invention.

FIGS. 4 and 5 show the manner in which the guide vane 10 is assembled. As shown in FIGS. 4 and 5, the diffuser section 11, the cover plate 13 and the return vanes 14 are fixed to the main plate 12 by laser welding. The arrow B in FIG. 4 indicates a welding direction, and laser welding (for example, YAG laser welding) is performed from the front side of the sheet surface of FIG. 4. The arrow C shown in FIG. 4 indicates a rotating direction of the impeller.

Figure 6:
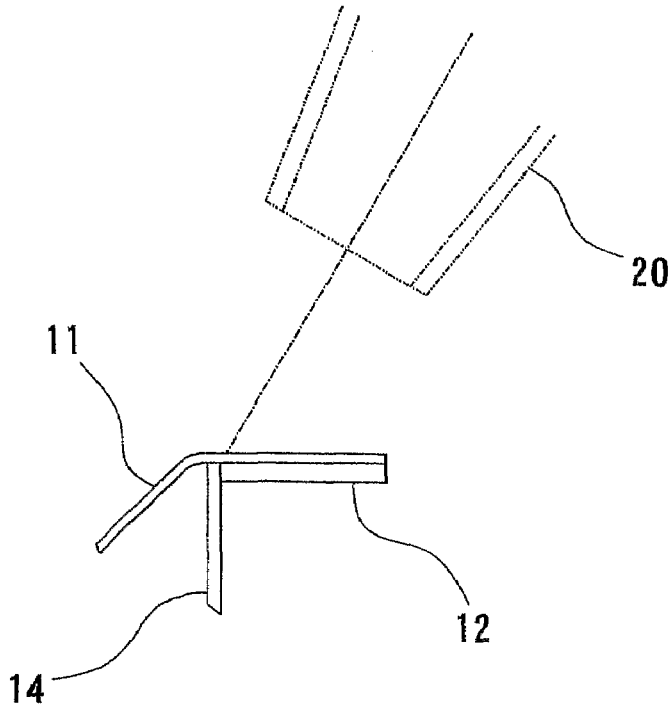
FIG. 6 is a view illustrating the manner of welding a diffuser section, a return vane, and a main plate of the centrifugal pump according to the embodiment of the present invention.
Figure 7:
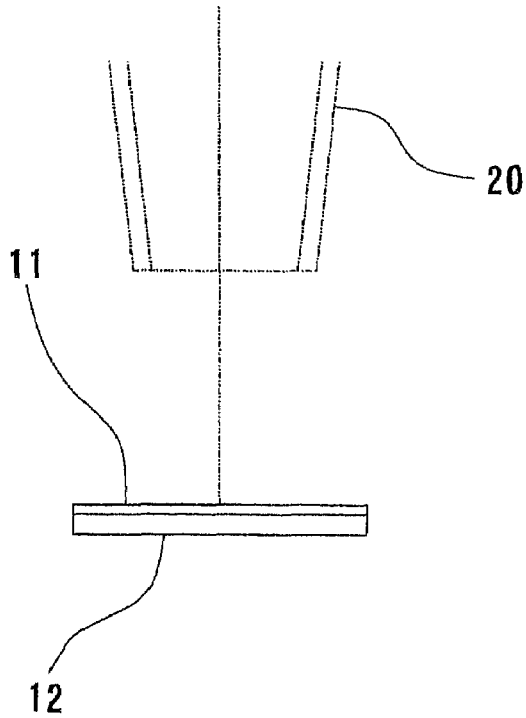
FIG. 7 is a view illustrating the manner of welding the diffuser section and the main plate.

In a welding portion L1 shown in FIG. 4, as shown in FIG. 6, the main plate 12, the return vanes 14 and the diffuser section 11 are welded from the side of the diffuser section 11 by penetration welding of laser using the nozzle 20, so that these three components 11, 12 and 14 are welded simultaneously. Further, in a welding portion L2, as shown in FIG. 7, the main plate 12 and the diffuser section 11 are welded from the side of the diffuser section 11 by penetration welding of laser using the nozzle 20. In a welding portion L3, as shown in FIG. 8, the cover plate 13 is interposed between the main plate 12 and the return vane 14, and the main plate 12, the cover plate 13 and the return vane 14 are welded from the side of the diffuser section 11 by penetration welding of laser using the nozzle 20, so that these three components 12, 13 and 14 are welded simultaneously. In this manner, all of the welding processes illustrated in FIGS. 6 through 8 are performed from the same side, i.e., the side of the diffuser section 11.

Figure 9:
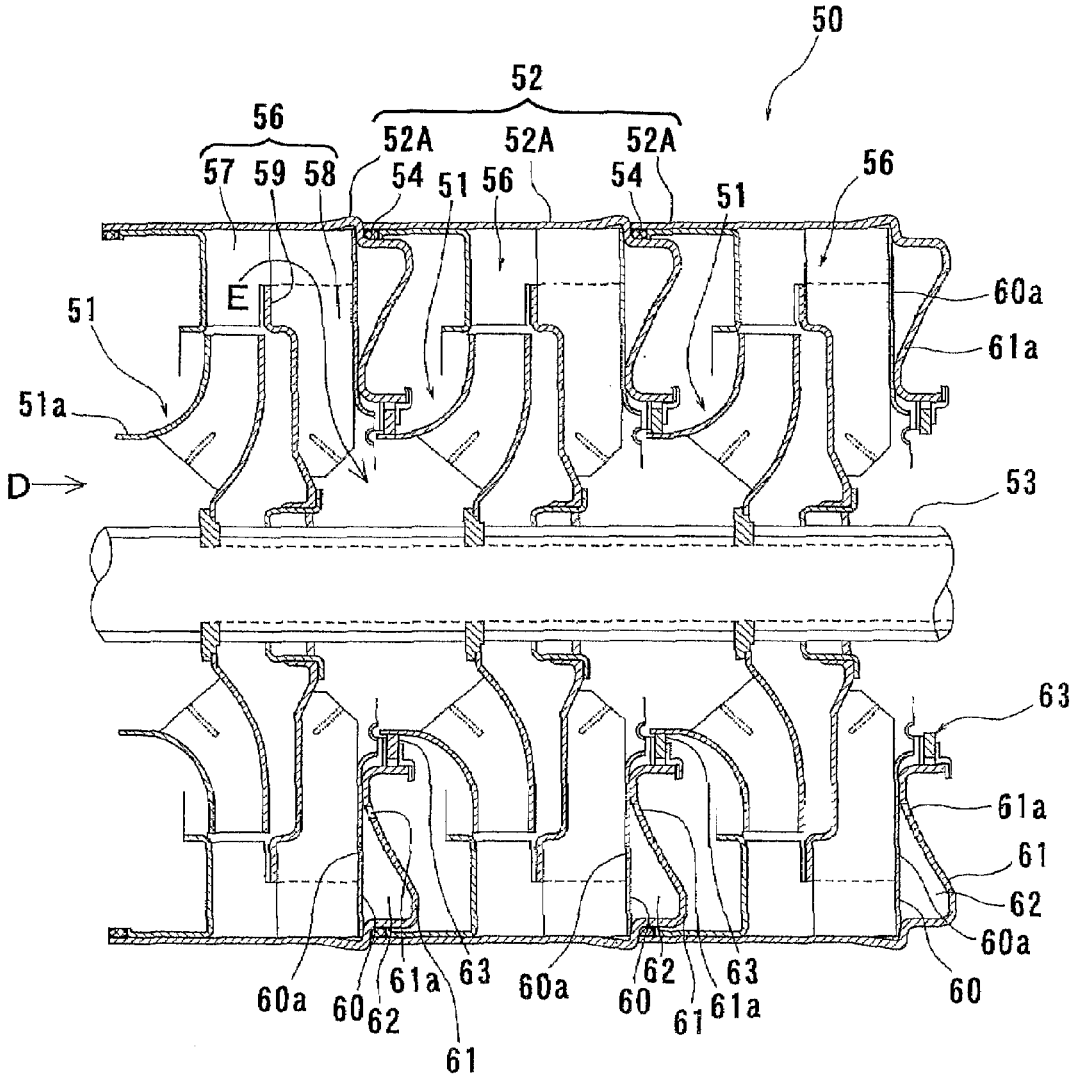
FIG. 9 is a view showing an essential part of a multistage centrifugal pump according to the embodiment of the present invention.

FIG. 9 is a view showing an essential part of a multistage centrifugal pump according to the embodiment of the present invention. As shown in FIG. 9, the multistage centrifugal pump 50 comprises a plurality of impellers 51, a casing 52 in which the impellers 51 are housed, and a rotatable main shaft 53 on which the impellers 51 are mounted. The casing 52 is divided into a plurality of interstage casings 52A. O-rings 54 are provided respectively at connecting portions of the adjacent interstage casings 52A.

The impellers 51 are disposed at equal intervals on the main shaft 53, and are integrally rotated with the main shaft 53. The suction ports 51*a* of the impellers 51 are in the same direction, and the impellers 51 are disposed on the main shaft 53 in series. The main shaft 53 is coupled to a motor (not shown), and the impellers 51 are rotated by the motor through the main shaft 53. The impeller 51 and the casing 52 are formed from a sheet metal such as stainless steel.

The multistage centrifugal pump 50 has a plurality of guide vanes 56 each having the same structure as the above-mentioned guide vane 10. Each of the guide vanes 56 comprises a diffuser section 57 for forming diffuser passages, a plurality of return vanes 58 for forming return passages, and a main plate 59 to which the diffuser section 57 and the return vanes 58 are fixed. Although not shown in FIG. 9, a cover plate is provided between the return vanes 58 and the main plate 59 in the same manner as described above so as to smoothen a step formed therebetween. Further, each of the guide vanes 56 is fixed to each of the inner circumferential surfaces of the interstage casings 52A, and is disposed in the vicinity of the outer periphery and the backside (discharge side) of each of the impellers 51.

A first annular partition wall 60 constituting a part of each of the return passages is fixed to the backside (discharge side) of the return vanes 58. The first partition wall 60 has a first through-hole 60*a* having a small inner diameter. A second annular partition wall 61 is provided at the discharge side of the first partition wall 60, and a space 62 is defined between the first partition wall 60 and the second partition wall 61. The second partition wall 61 has a second through-hole 61*a* having an inner diameter substantially equal to the inner diameter of the first through-hole 60*a*. In this embodiment, the first partition wall 60 and the second partition wall 61 are formed from a sheet metal such as stainless steel. In this embodiment, a portion extending from the interstage casing 52A constitutes the second partition wall 61.

With the multistage centrifugal pump having the above structure, when the impellers 51 are rotated by the motor, a liquid is introduced into the impeller 51 through the suction port 51*a* in the direction of arrow D shown in FIG. 9. The liquid introduced into the impeller 51 is pressurized by the rotating impeller 51, and is discharged from the outer periphery of the impeller 51 toward the guide vane 56. The liquid introduced into the guide vane 56 flows in the direction of arrow E in the guide vane 56. At this time, the liquid passes through the diffuser section 57 to decrease its velocity, and thus velocity energy of the liquid is efficiently converted into pressure energy of the liquid. The liquid which has passed through the diffuser section 57 is led by the return vanes 58 to the suction port 51*a* of the next-stage impeller 51. In this manner, the liquid is pressurized successively by the multistage impellers 51, and the pressure head of the liquid is recovered successively by the multistage diffuser sections 57. Finally, the pressurized liquid is discharged from the discharge port (not shown) of the multistage centrifugal pump.

As described above, the liquid is successively pressurized by each of the multistage impellers 51, and the liquids having different pressures are partitioned by the first partition wall 60 and the second partition wall 61 into a high-pressure side and a low-pressure side. According to the multistage centrifugal pump of the present embodiment, in order to prevent the liquid in the casing 52 from leaking from the high-pressure side toward the low-pressure side, a floating-type liner ring 63 is provided.

Although a certain preferred embodiment of the present invention has been described in detail, it should be understood that various changes and modifications may be made without departing from the scope of the appended claims for patent, and the scope of the technical concept described in the specification and drawings.

INDUSTRIAL APPLICABILITY

The present invention is applicable to a centrifugal pump whose components such as an impeller and a casing are manufactured from a sheet metal and a method of manufacturing such a centrifugal pump.

The invention claimed is:

1. A centrifugal pump for pressurizing a fluid by rotating an impeller, said centrifugal pump comprising:

a diffuser section configured to define a plurality of diffuser passages for decreasing a velocity of the fluid discharged from said impeller, said diffuser section being formed from a sheet metal;

a return vane configured to define a plurality of return passages for leading the fluid which has passed through said diffuser passages to a discharge port, said return vane being formed from a sheet metal, said return vane being continuous with said diffuser section;

a main plate to which said diffuser section and said return vane are fixed to define said diffuser passages and said return passages, respectively; and an outer casing enclosing said diffuser section, said return vane, and said main plate;

wherein said diffuser section, said return vane, said main plate, and said outer casing are configured and arranged such that each one of said diffuser passages communicates with a respective one of said return passages to form a pressure head recovery passage separated from circumferentially adjacent pressure head recovery passages so as to prevent flow of fluid between circumferentially adjacent pressure head recovery passages.

2. The centrifugal pump according to claim 1, wherein said main plate is formed from a sheet metal.

3. The centrifugal pump according to claim 1, further comprising a structural member configured to smoothen a flow of fluid between each of said diffuser passages and said respective one of said return passages, said structural member being a cover plate formed from a single sheet metal.

4. The centrifugal pump according to claim 3, said return vane engages with said cover plate to prevent said cover plate from moving.

5. The centrifugal pump according to claim 1, wherein said main plate has a first side and a second side opposite said first side, said diffuser section being fixed to said first side of said main plate by a weld, and said return vane being fixed to said second side of said main plate by a weld.

6. A method of manufacturing a centrifugal pump for pressurizing a fluid by rotating an impeller, said method comprising:

forming a diffuser section from a sheet metal, said diffuser section being shaped to define a plurality of separated diffuser passages for decreasing a velocity of the fluid discharged from said impeller;

forming a return vane from a sheet metal, said return vane being shaped to define a plurality of separated return passages for leading the fluid which has passed through said diffuser section to a discharge side;

forming a main plate from a sheet metal; and assembling said diffuser section, said return vane, and said main plate together to form a single, unitary structure by using welding processes, said diffuser section, said return vane, and said main plate being arranged to define said separated diffuser passages and said separated return passages, all of said welding processes being performed from the same side of the single, unitary structure.

7. The method of manufacturing a centrifugal pump according to claim 6, further comprising forming a structural member from a sheet metal, and assembling said structural member to said diffuser section, said return vane, and said main plate by welding processes to form the single, unitary structure, all of said welding processes being performed from the same side of the single, unitary structure.

8. The method of manufacturing a centrifugal pump according to claim 7, wherein said structural member is a cover plate formed from a single piece of sheet metal.

9. The method of manufacturing a centrifugal pump according to claim 7, wherein said assembling comprises integrally assembling said structural member to said return vane by a single one of said welding processes conducted separately from a remainder of said welding processes.

* * * * *